US010619911B2

(12) United States Patent
Park et al.

(10) Patent No.: US 10,619,911 B2
(45) **Date of Patent: *Apr. 14, 2020**

(54) REFRIGERATOR

(71) Applicant: SAMSUNG ELECTRONICS CO., LTD., Suwon-si, Gyeonggi-do (KR)

(72) Inventors: Wan Su Park, Suwon-si (KR); Po Cheon Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/389,549

(22) Filed: Apr. 19, 2019

(65) Prior Publication Data

US 2019/0242639 A1 Aug. 8, 2019

Related U.S. Application Data

(63) Continuation of application No. 15/642,830, filed on Jul. 6, 2017, now Pat. No. 10,302,349.

(30) Foreign Application Priority Data

Jul. 28, 2016 (KR) ..... 10-2016-0096468

(51) Int. Cl.
*F25D 23/02* (2006.01)
*E05D 11/00* (2006.01)
(Continued)

(52) U.S. Cl.
CPC ..... *F25D 23/028* (2013.01); *E05D 11/0054* (2013.01); *E05D 11/0081* (2013.01);
(Continued)

(58) Field of Classification Search
CPC ..... F25D 23/028; F25D 23/06; F25D 23/065; F25D 2323/022; F25D 2323/024;
(Continued)

(56) References Cited

U.S. PATENT DOCUMENTS 5,064,255 A 11/1991 Inui et al.
10,302,349 B2 * 5/2019 Park ..... E05D 11/0054
(Continued)

FOREIGN PATENT DOCUMENTS

CN 102374721 A 3/2012
DE 195 05 998 A1 8/1996
(Continued)

OTHER PUBLICATIONS

Translated Description WO2010007079, 13 pages (Year: 2010).*
(Continued)

*Primary Examiner* — Andrew M Roersma
(74) *Attorney, Agent, or Firm* — Staas & Halsey LLP

(57) ABSTRACT

A refrigerator includes a main body on which a hinge for rotatably supporting the door is mounted, a base frame mounted on the main body and having a first hinge accommodating portion formed at one end portion and a second hinge accommodating portion formed at the other end portion that is opposite to the one end portion, a hinge cover mounted on one of the first hinge accommodating portion and the second hinge accommodating portion, and configured to cover the hinge, and a cover frame configured to be coupled with the base frame by sliding in a first direction or by sliding in a second direction that is opposite to the first direction.

20 Claims, 15 Drawing Sheets

(51) Int. Cl.
*F25D 29/00* (2006.01)
*F25D 11/00* (2006.01)

(52) U.S. Cl.
CPC ..... *F25D 11/00* (2013.01); *F25D 29/005* (2013.01); *E05Y 2900/31* (2013.01); *F25D 2323/022* (2013.01); *F25D 2323/024* (2013.01); *F25D 2400/361* (2013.01); *F25D 2400/40* (2013.01)

(58) Field of Classification Search
CPC ..... F25D 2400/04; F25D 2400/40; E05D 11/0054; E05D 11/0081; E05Y 2900/31
See application file for complete search history.

(56) References Cited

U.S. PATENT DOCUMENTS

| | | | |
|---|---|---|---|
| 2005/0138948 | A1 | 6/2005 | Lee |
| 2012/0038259 | A1 | 2/2012 | Lee et al. |
| 2012/0260683 | A1 | 10/2012 | Cheon |
| 2015/0211783 | A1 | 7/2015 | Marutani |
| 2016/0123055 | A1 | 5/2016 | Ueyama |
| 2018/0031312 | A1 | 2/2018 | Kim |

FOREIGN PATENT DOCUMENTS

| | | | | |
|---|---|---|---|---|
| DE | 102009027630 | A1 * | 1/2011 | ..... F25D 29/005 |
| DE | 10 2012 223 648 | A1 | 6/2014 | |
| EP | 1 191 289 | A2 | 3/2002 | |
| EP | 2 318 791 | | 5/2011 | |
| EP | 2 525 176 | A2 | 11/2012 | |
| EP | 2 743 435 | A1 | 6/2014 | |
| EP | 2 743 435 | A2 | 6/2014 | |
| EP | 2 525 176 | A3 | 10/2015 | |
| JP | 59-94277 | | 6/1984 | |
| JP | 2007-85639 | | 4/2007 | |
| KR | 20-0220727 | | 4/2001 | |
| KR | 2001-0059567 | | 7/2001 | |
| KR | 10-1728731 | | 4/2017 | |
| WO | WO 2010/007079 | | 1/2010 | |
| WO | WO 2010/010011 | A2 | 1/2010 | |
| WO | 2010/029094 | A2 | 3/2010 | |
| WO | 2010/029094 | A3 | 3/2010 | |
| WO | WO 2010/029094 | A2 | 3/2010 | |
| WO | WO 2015/029000 | A1 | 3/2015 | |

OTHER PUBLICATIONS

Chinese Office Action dated Aug. 5, 2019 in related Chinese Application No. 201710607149.
Extended European Search Report dated Nov. 7, 2017 in corresponding European Patent Application 17179495.1, 8 pp.
European Patent Office issued Communication pursuant to Article 94(3)EPC in European Application No. 17 179 495.1 dated Feb. 21, 2019.
Notice of Allowance dated Jan. 17, 2019 in co-pending U.S. Appl. No. 15/642,830.
Final Office Action dated Oct. 9, 2018 in co-pending U.S. Appl. No. 15/642,830.
Office Action dated Jun. 15, 2018 in co-pending U.S. Appl. No. 15/642,830.
U.S. Appl. No. 15/642,830, filed Jul. 6, 2017, Wan Su Park et al., Samsung Electronics Co., Ltd.

* cited by examiner

REFRIGERATOR

CROSS-REFERENCE TO RELATED APPLICATION

This application is a Continuation of application Ser. No. 15/642,830 filed Jul. 6, 2017, and claims the benefit of priority from the prior Korean Patent Application No. 10-2016-0096468, filed on Jul. 28, 2016, in the Korean Intellectual Property Office, the disclosure of which is incorporated herein by reference.

BACKGROUND

1. Field

Embodiments of the present disclosure relate to a refrigerator, and more particularly, to a refrigerator having an improved assembling structure.

2. Description of the Related Art

Generally, a refrigerator includes a storage compartment for storing food, and a cool-air supplying apparatus for supplying cool air to the storage compartment to keep food fresh.

Typical refrigerators could have performed only a function of storing food at low temperature. However, in recent years, a need for performing other functions in addition to the function of storing food is increasing.

Accordingly, recently, a refrigerator in which a display with input and output functions, a Universal Serial Bus (USB) connecting unit and/or a camera is installed in a door is being developed. Electronic components of the refrigerator are installed in the upper portion of the main body, and the main body has space for accommodating the electronic components.

Wires for connecting the display, the USB connecting unit and/or the camera installed in the door to the electronic components installed in the main body extend from the space for accommodating the electronic components to the door. If the wires are exposed to the outside of the main body, a user who uses the refrigerator may experience inconvenience, and the outer appearance of the refrigerator may deteriorate.

In order to solve the problem, various methods have been suggested to cover the space for accommodating the electronic components, however, typical cover units are not easy to assemble and disassemble, have a poor appearance, and have gaps between parts.

SUMMARY

An aspect of the present disclosure is to provide a refrigerator capable of easily assembling and disassembling cover units covering space for accommodating electronic components.

Another aspect of the present disclosure is to provide a refrigerator that can be installed by easily changing the center of rotation of a door.

Another aspect of the present disclosure is to provide a refrigerator capable of improving the outer appearance of cover units covering space for accommodating electronic components.

Another aspect of the present disclosure is to provide a refrigerator capable of improving a gap made between cover units covering space for accommodating electronic components.

In accordance with one aspect of the present disclosure, a refrigerator includes a main body on which a hinge for rotatably supporting the door is mounted, a base frame mounted on the main body and having a first hinge accommodating portion formed at one end portion and a second hinge accommodating portion formed at the other end portion that is opposite to the one end portion, a hinge cover mounted on one of the first hinge accommodating portion and the second hinge accommodating portion, and configured to cover the hinge, and a cover frame configured to be coupled with the base frame by sliding in a first direction or by sliding in a second direction that is opposite to the first direction.

The cover frame may be coupled with the base frame by sliding in the first direction when the hinge cover is mounted on the first hinge accommodating portion, and the cover frame may be coupled with the base frame by sliding in the second direction when the hinge cover is mounted on the second hinge accommodating portion.

The first direction may be set to a direction from the other end portion to the one end portion of the base frame, and the second direction may be set to a direction from the one end portion to the other end portion of the base frame.

The cover frame may be configured to cover the entire of one of the first hinge accommodating portion and the second hinge accommodating portion, and a part of the other one of the first hinge accommodating portion and the second hinge accommodating portion.

The cover frame may include a frame hook, and the base frame includes a frame connecting portion connected to the frame hook.

The frame hook may include a first extending portion configured to restrict a movement of the cover frame in a direction in which the cover frame slides and in a third direction that is perpendicular to the direction in which the cover frame slides, and a second extending portion configured to restrict a movement of the cover frame in a fourth direction that is perpendicular to the direction in which the cover frame slides and perpendicular to the third direction.

The frame connecting portion may include a hook inserting portion into which the frame hook is inserted, a first hook fixing portion extending from the hook inserting portion in the first direction of the base frame, and a second hook fixing portion extending from the hook inserting portion in the second direction of the base frame.

The door may include a camera, a display, or a Universal Serial Bus (USB) connecting unit, the main body may include electronic component accommodating space, and a wire disposed in the electronic component accommodating space may pass through the inside of the hinge cover to extend to the camera, the display, or the USB connecting unit.

The hinge cover may include a wire guiding part configured to guide the wire disposed in the inside of the hinge cover to be spaced apart from the hinge.

The base frame may include a first connecting portion provided in the first hinge accommodating portion and a second connecting portion provided in the second hinge accommodating portion, and the hinge cover may include a hinge cover hook having elasticity and configured to be hooked to the first connecting portion or the second connecting portion.

The hinge cover may include a cover inserting portion which a portion of a front end portion of the cover frame is inserted into and fixed in along a direction in which the cover frame slides.

The base frame may be coupled with the main body by at least one of hook coupling and screw coupling.

One end portion of the hinge cover may be supported by the base frame, and the other end portion of the hinge cover that is opposite to the one end portion of the hinge cover is supported by the cover frame.

One end portion of the cover frame may be supported by the hinge cover, and the other end portion of the cover frame that is opposite to the one end portion of the cover frame cover is supported by the base frame.

The base frame may be formed such that one side of the base frame in which the first hinge accommodating portion is formed and the other side of the base frame in which the second hinge accommodating portion is formed are symmetrical with respect to the center in a direction in which the cover frame slides.

In accordance with another aspect of the present disclosure, a refrigerator includes a main body having electronic component accommodating space at the upper portion, a base frame mounted on the main body to cover an opened front portion of the electronic component accommodating space, the base frame including a first hinge accommodating portion formed at a right end portion and a second hinge accommodating portion formed at a left end portion, a hinge cover mounted on one of the first hinge accommodating portion and the second hinge accommodating portion, and a cover frame configured to be coupled with the base frame by sliding from the left to the right of the base frame when the hinge cover is mounted on the first hinge accommodating portion, and to be coupled with the base frame by sliding from the right to the left of the base frame when the hinge cover is mounted on the second hinge accommodating portion.

The hinge cover may include a wire guiding part to guide a wire disposed in the inside of the hinge cover to be spaced apart from the hinge.

The base frame may be formed to be symmetrical with respect to the center in a direction in which the cover frame slides.

In accordance with still another aspect of the present disclosure, a refrigerator includes a main body having electronic component accommodating space, a base frame mounted on the main body to cover an opened portion of the electronic component accommodating space, the base frame including a first hinge accommodating portion formed at one end portion and a second hinge accommodating portion formed at the other end portion that is opposite to the one end portion, a hinge cover mounted on one of the first hinge accommodating portion and the second hinge accommodating portion, and a cover frame configured to cover the entire of one of the first hinge accommodating portion and the second hinge accommodating portion and a part of the other one of the first hinge accommodating portion and the second hinge accommodating portion.

The cover frame ray be coupled with the base frame by sliding in a first direction when the hinge cover is mounted on the first hinge accommodating portion, and the cover frame may be coupled with the base frame by sliding in a second direction that is opposite to the first direction when the hinge cover is mounted on the second hinge accommodating portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
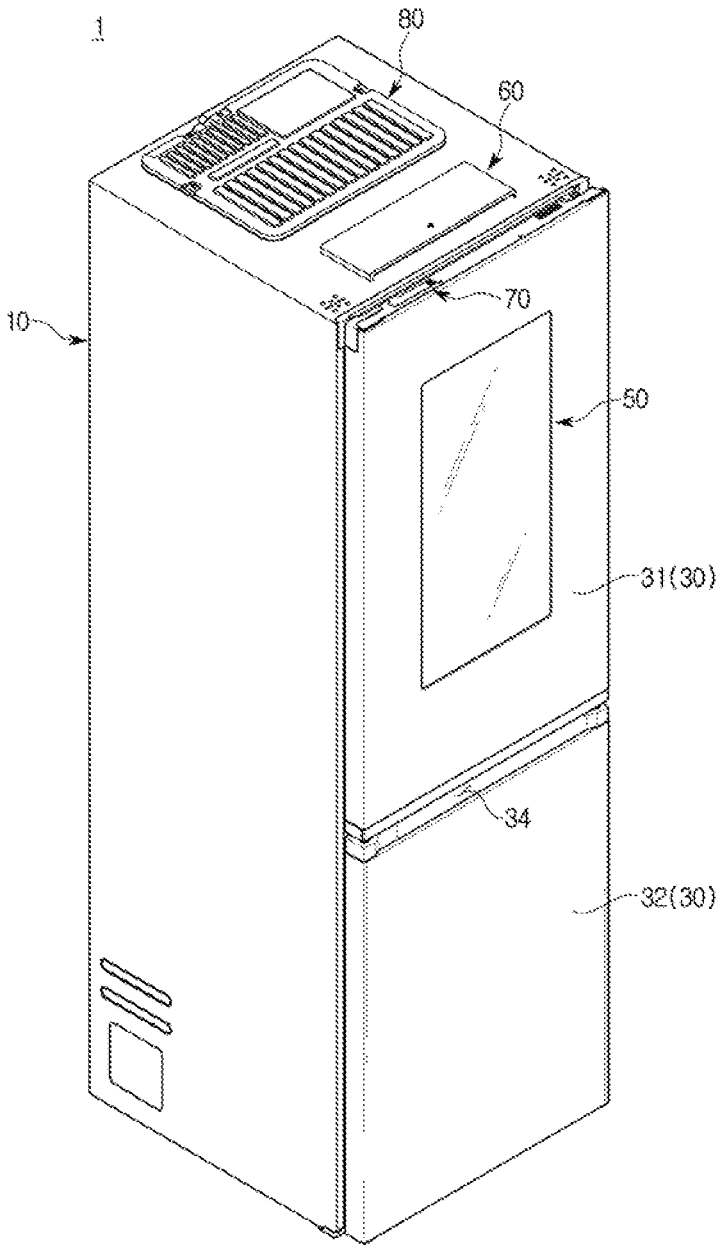
FIG. 1 shows the outer appearance of a refrigerator according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols used in the drawings of the present specification represent members or components performing the substantially same functions.

Also, the terms used in the present specification are used to describe the embodiments of the present disclosure. Accordingly, it should be apparent to those skilled in the art that the following description of exemplary embodiments is provided for illustration purpose only and not for the purpose of limiting the embodiments as defined by the appended claims and their equivalents. It is to be understood that the singular forms "a," "an," and "the" include plural referents unless the context clearly dictates otherwise. In this specification, it will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

The terms "front end", "rear end", "upper portion", "lower portion", "upper end", and "lower end" used in the following description are defined based on the drawings, and the shape and position of each component are not limited by these terms.

Hereinafter, the embodiments of the present disclosure will be described in detail with reference to the accompanying drawings.

Generally, refrigerators are classified according to the positions of storage compartments and the shapes of doors.

There are a Top Mounted Freezer (TMF) type refrigerator in which a storage compartment is divided into upper and lower areas by a horizontal partition to form the upper area as a freezing compartment and the lower area as a refrigerating compartment, and a Bottom Mounted Freezer (BMF) type refrigerator in which a refrigerating compartment is formed in the upper area and a freezing compartment is formed in the lower area.

Also, there are a Side By Side (SBS) type refrigerator in which a storage compartment is divided into left and right areas by a vertical partition to form one area as a freezing compartment and the other area as a refrigerating compartment, and a French Door Refrigerator (FDR) type refrigerator in which a storage compartment is divided into upper and lower areas by a horizontal partition to form the upper area as a refrigerating compartment and the lower area as a freezing compartment wherein the upper refrigerating compartment is opened or closed by a pair of doors.

Hereinafter, for convenience of description, a BMF type refrigerator will be described as a refrigerator according to an embodiment of the present disclosure, however, the present disclosure is not limited to the BMF type refrigerator.

Figure 2:
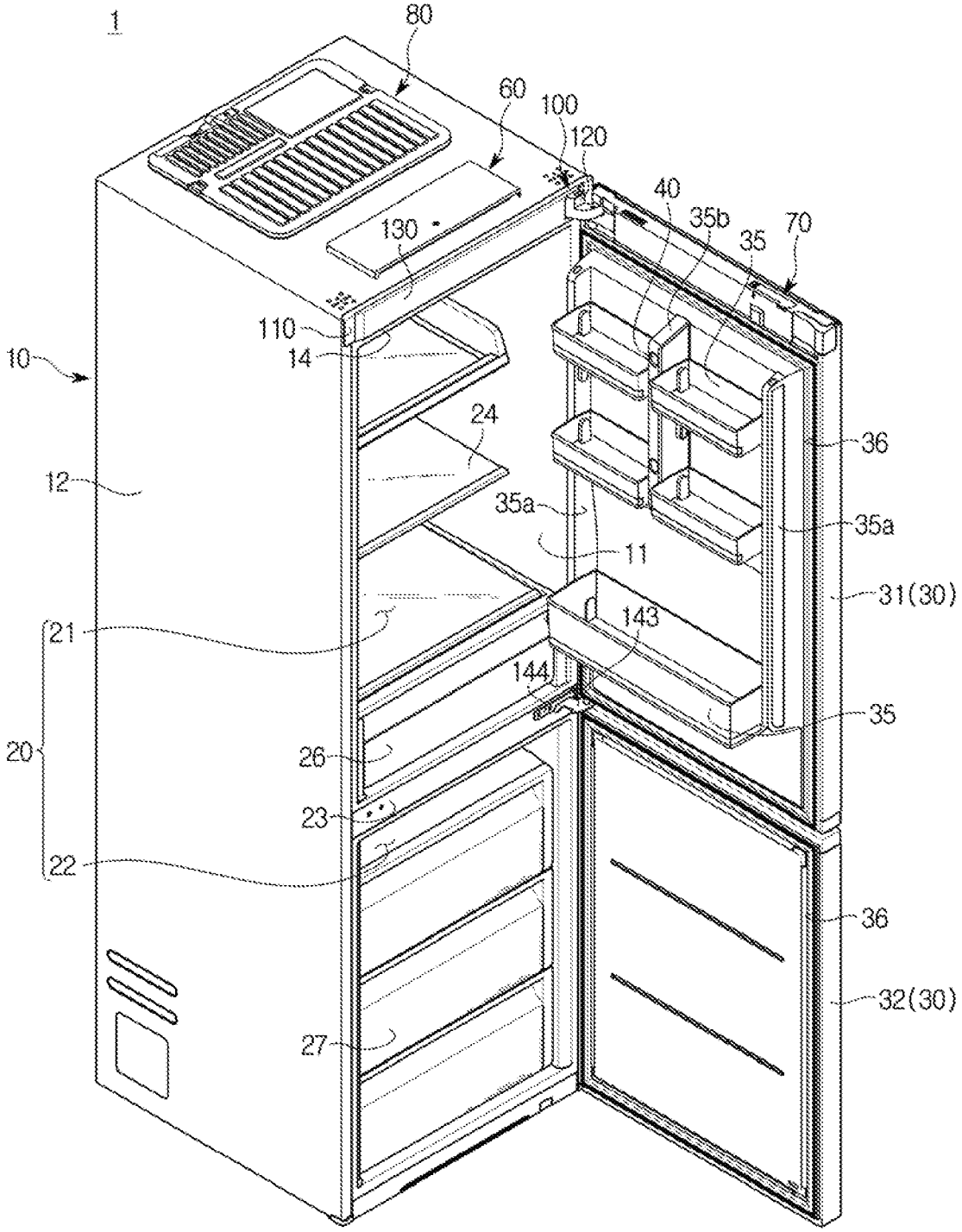
FIG. 2 is a perspective view of the refrigerator according to an embodiment of the present disclosure when the doors of the refrigerator open.

FIG. 1 shows the outer appearance of a refrigerator according to an embodiment of the present disclosure. FIG. 2 is a perspective view of the refrigerator according to an embodiment of the present disclosure when the doors of the refrigerator open.

Referring to FIGS. 1 and 2, a refrigerator 1 according to an embodiment of the present disclosure may include a main body 10, a storage compartment 20 (that is, upper and lower storage compartments 21 and 22) which is formed in the inside of the main body 10 and whose front portion opens, and a door 30 rotatably coupled with the main body 10 and configured to open or close the opened front portions of the storage compartments 21 and 22.

The main body 10 may form the outer appearance of the refrigerator 1. The main body 10 may include an inner case 11 forming the storage compartment 20, and an outer case 12 coupled with the outer portion of the inner case 11 and forming the outer appearance of the refrigerator 1. In addition, the main body 10 may include a cool-air supplying apparatus (not shown) for supplying cool air to the storage compartment 20.

The cool-air supplying apparatus may include a compressor, a condenser, an expansion valve, an evaporator, a blow fan, a cooling air duct, etc. An insulating material (not shown) may be filled between the inner case 11 and the outer case 12 of the main body 10 to prevent cool air from leaking out of the storage compartment 20.

A machine room (not shown) may be provided in the rear lower area of the main body 10. In the machine room, the compressor for compressing refrigerant, and the condenser for condensing the compressed refrigerant may be installed.

The main body 10 may have electronic component accommodating space 13 (see FIG. 3) in the upper area of the upper storage compartment 21 which will be described later. The electronic component accommodating space 13 may be partitioned from the upper storage compartment 21 by an insulating partition 14, and various electronic components for driving the refrigerator 1 may be disposed in the electronic component accommodating space 13. Details about the electronic component accommodating space 13 will be described later.

The storage compartment 20 may be partitioned into the upper storage compartment 21 and the lower storage compartment 22 by a horizontal partition 23. The refrigerator 1 according to the embodiment of the present disclosure may be a BMF type refrigerator in which the upper storage compartment 21 is a refrigerating compartment and the lower storage compartment 22 is a freezing compartment, although not limited to the BMF type refrigerator. According to another example, the refrigerator 1 according to the embodiment of the present disclosure may be a TMF type refrigerator in which the upper storage compartment 21 is a freezing compartment and the lower storage compartment 22 is a refrigerating compartment. However, for convenience of description, the refrigerator 1 is assumed to be a BMF type refrigerator.

The upper storage compartment 21 may be provided with a shelf 24 to place food thereon, an airtight container 25 to airtightly seal and store food therein, and a drawer 26 to slide to be withdrawn from or put into the upper storage compartment 21. The lower storage compartment 22 may be provided with a drawer 27 to slide to be withdrawn from or put into the lower storage compartment 22.

The front portion of the storage compartment 20 may open to enable a user to put or take food, and the opened front portion of the storage compartment 20 may be opened or closed by the door 30.

The upper storage compartment 21 may be opened or closed by an upper door 31 rotatably connected to the main body 10. The lower storage compartment 22 may be opened and closed by the lower door 32 rotatably connected to the main body 10. Herein, the upper door 31 may be rotatably supported on the main body 10 by a hinge 141 and a middle hinge 143.

On the rear surface of the upper door 31, a door shelf 35 to store food therein may be provided.

On the rear surface of the upper door 31, a first shelf supporting portion 35*a* extending vertically may be provided to support at least one of the left and right ends of the door shelf 35. The first shelf supporting portion 35*a* may be provided as a separate member that can be separated from the upper door 31. In the current embodiment, the first shelf supporting portion 35*a* may extend from the rear surface of the upper door 31.

In addition, on the rear surface of the upper door 31, a second shelf supporting portion 35*b* may extend vertically at a substantially center portion. With the configuration, on the rear surface of the upper door 31, a plurality of door shelves 35 may be disposed in parallel with each other, or asymmetrically with the second shelf supporting portion 35*b* in between. In the second shelf supporting portion 35*b*, a camera 40 may be installed to photograph the inside of the upper storage compartment 21.

The lower door 32 may include a lower handle 34 at the upper end. A user may grip the lower handle 34 to easily open or close the lower door 32. The lower handle 34 may extend in the left-right direction of the lower door 32, and may be recessed inward from the lower door 32, although the shape of the lower handle 34 is not limited to this. That is, the lower handle 34 may have any other shape as long as it can be easily gripped by a user.

In the edges of the rear surfaces of the upper door 31 and the lower door 32, a gasket 36 may be provided to seal gaps between the upper and lower doors 31 and 32 and the main body 10 when the upper and lower doors 31 and 32 are closed. The gasket 36 may be installed in the form of a loop along the edges of the rear surfaces of the upper door 31 and the lower door 32, and include a magnet (not shown) therein.

The refrigerator 1 according to the embodiment of the present disclosure may further include a display 50 having an input and output function. The display 50 may be installed in the upper door 31 for the user's convenience.

The refrigerator 1 according to an embodiment of the present disclosure may include a cover member 60 to cover a speaker assembly (not shown) disposed in the upper portion of the main body 10.

The refrigerator 1 according to the embodiment of the present disclosure may include a USB connecting unit 70 disposed in the upper portion of the upper door 31 and configured to connect a USB.

The refrigerator 1 according to the embodiment of the present disclosure may include an electric part 80 disposed in the upper portion. The electric part 80 may include electronic components for driving the refrigerator 1, and may be electrically connected to electronic components disposed in the electronic component accommodating space 13 described above.

Figure 3:
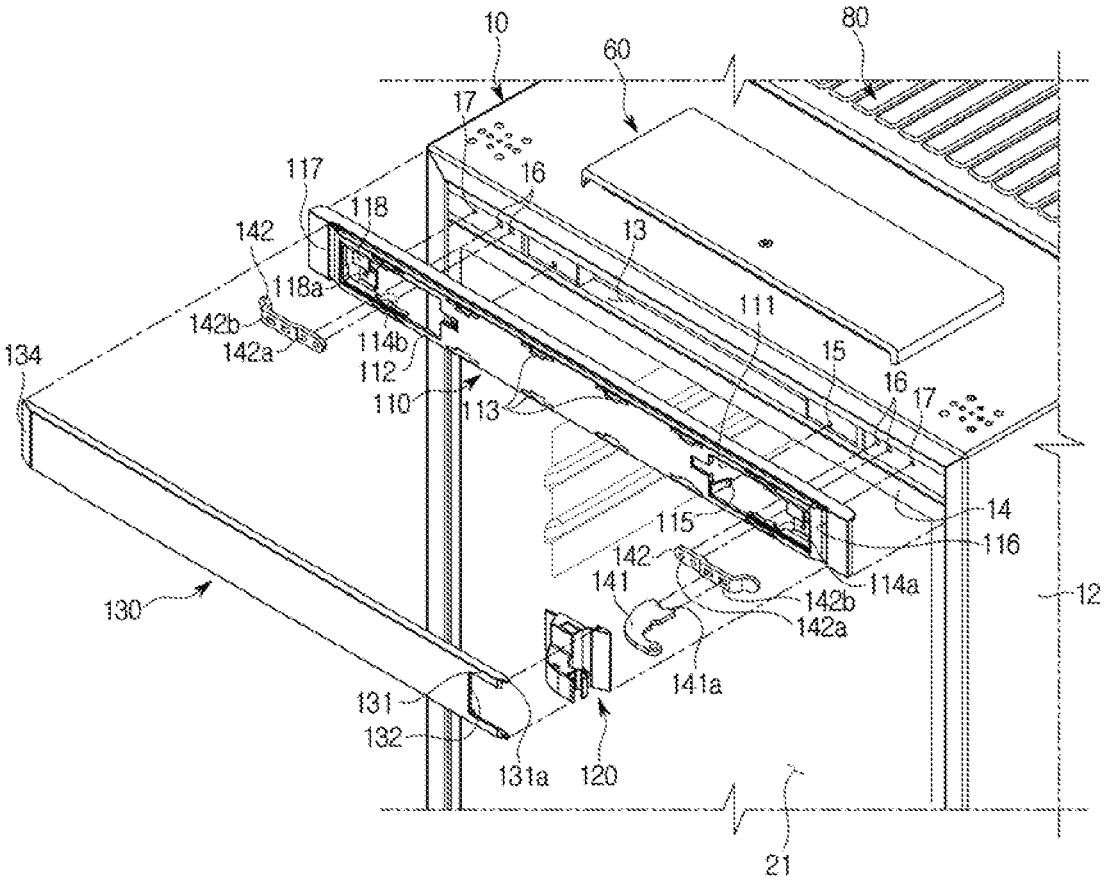
FIG. 3 is an exploded view of a cover unit of the refrigerator according to an embodiment of the present disclosure.
Figure 4:
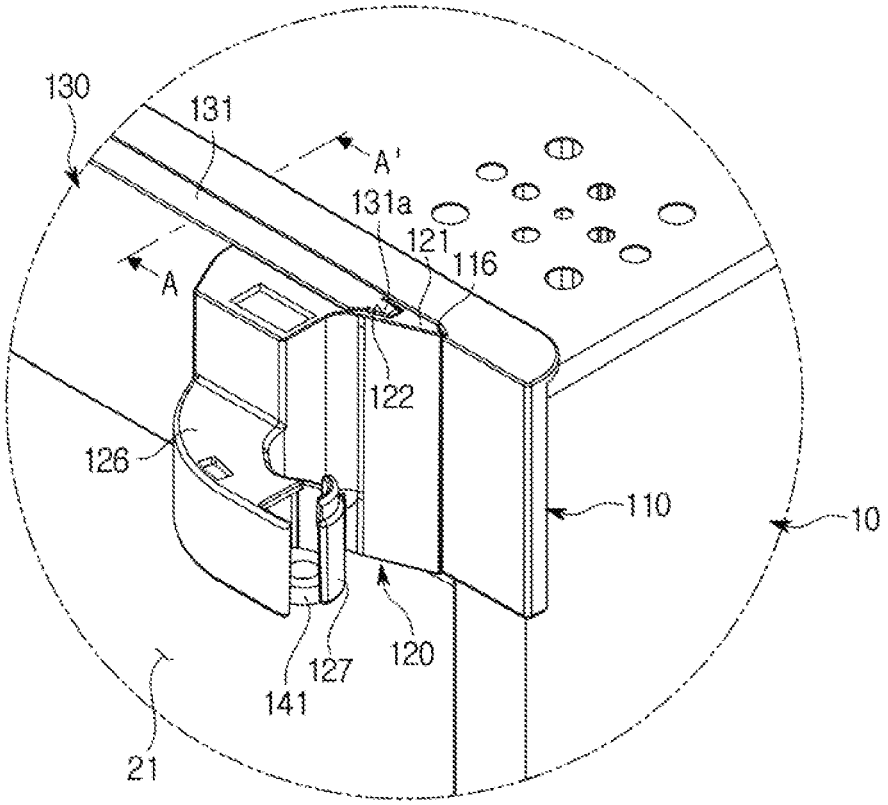
FIGS. 4 and 5 are enlarged views showing a state in which the hinge cover according to an embodiment of the present disclosure is engaged.
Figure 5:
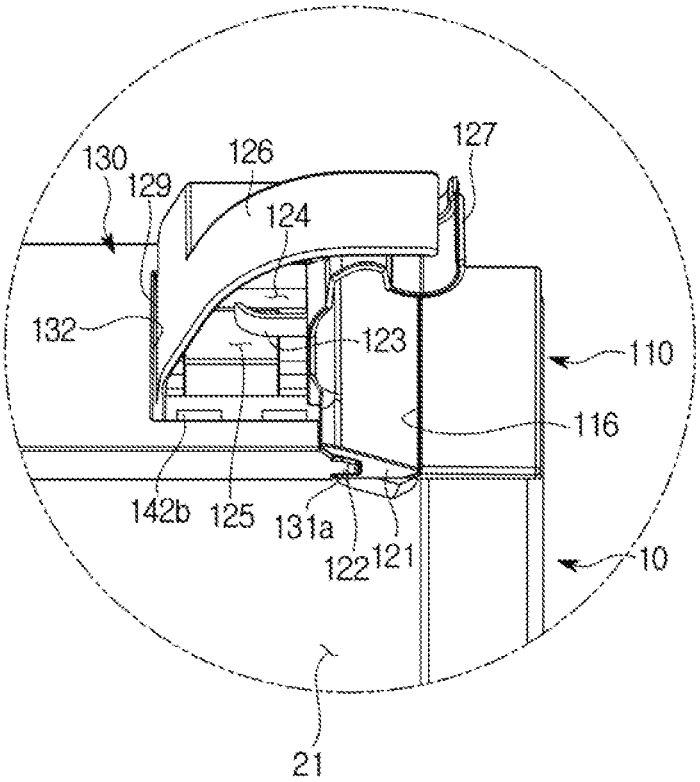
Figure 6:
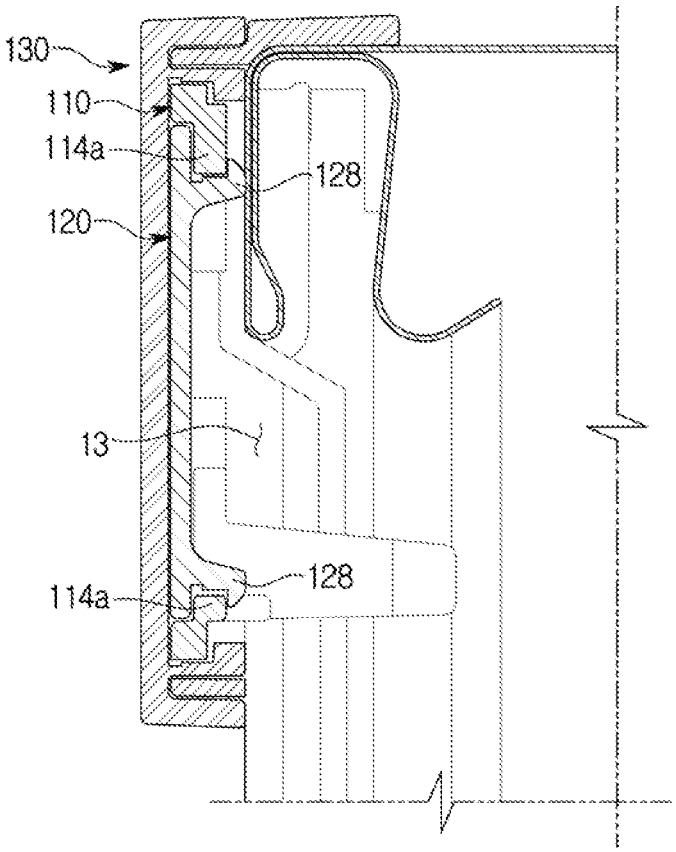
FIG. 6 is a cross-sectional view taken along a line A-A' shown in FIG. 4.
Figure 7:
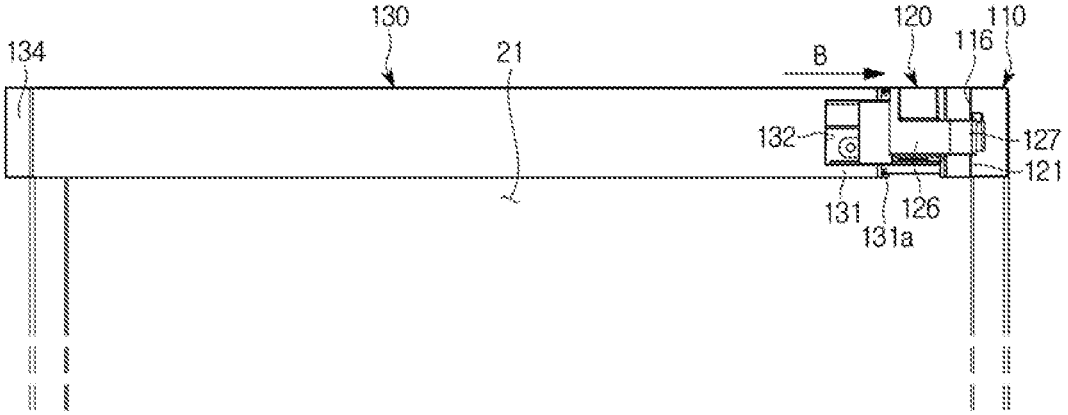
FIGS. 7, 8, 9 and 10 are views for describing a process in which the cover frame according to an embodiment of the present disclosure is coupled with the base frame from the left to the right of the base frame.
Figure 8:
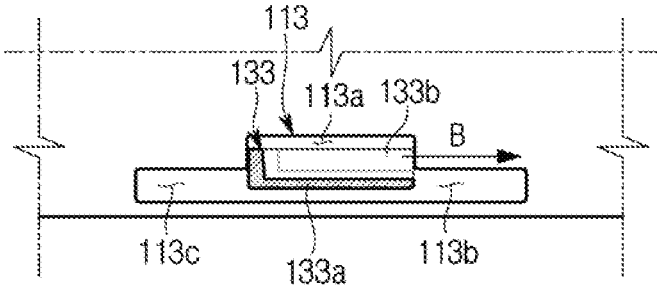
Figure 9:
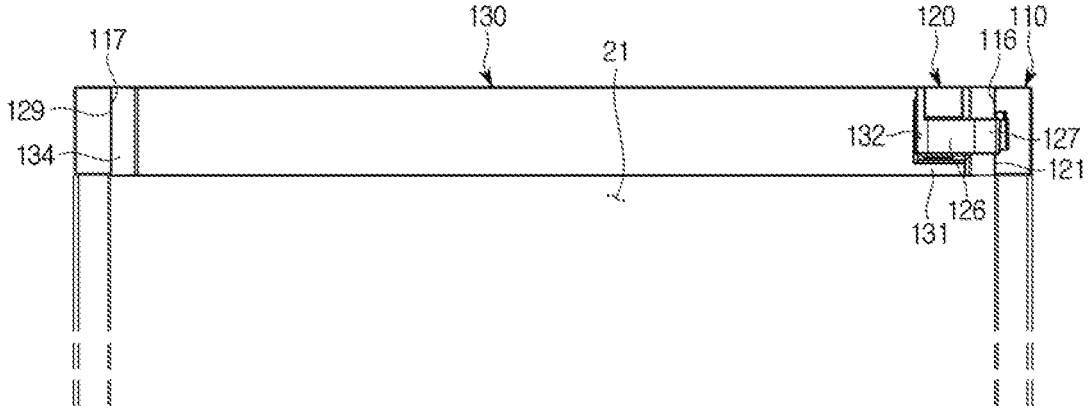
Figure 10:
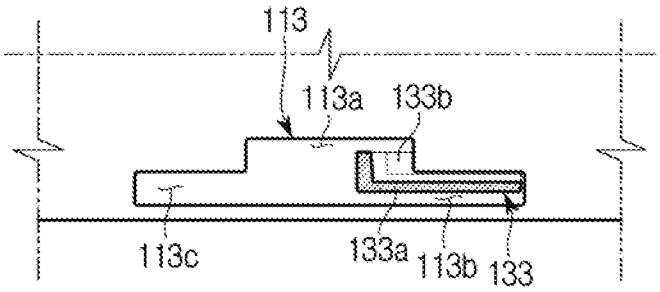
Figure 11:
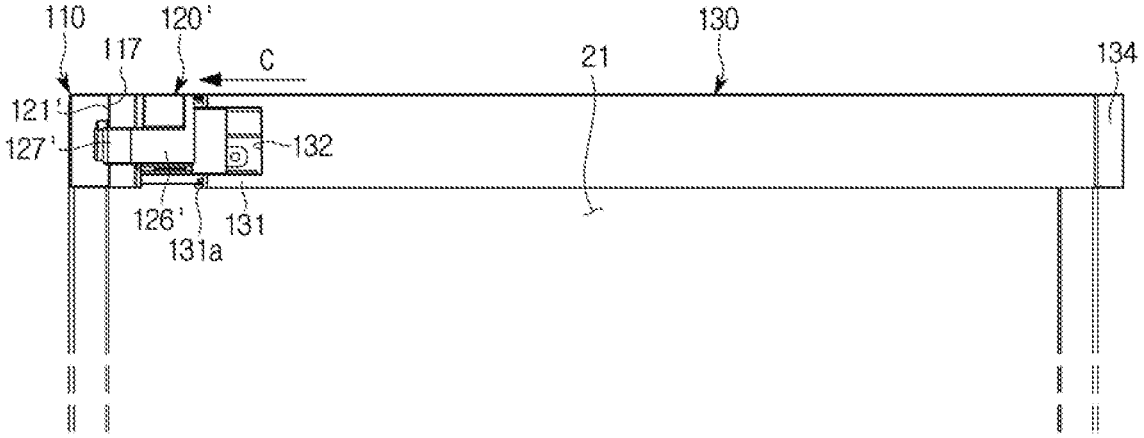
FIGS. 11, 12, 13 and 14 are views for describing a process in which the cover frame according to an embodiment of the present disclosure is coupled with the base frame from the right to the left of the base frame.
Figure 12:
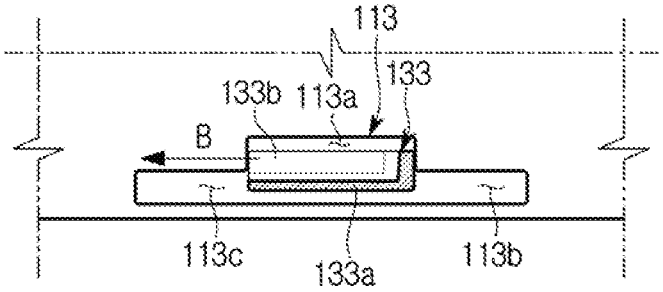

FIG. 3 is an exploded view of a cover unit of the refrigerator according to an embodiment of the present disclosure. FIGS. 4 and 5 are enlarged views showing a state in which the hinge cover according to an embodiment of the present disclosure is engaged. FIG. 6 is a cross-sectional view taken along a line A-A' shown in FIG. 4. FIGS. 7, 8, 9 and 10 are views for describing a process in which the cover frame according to an embodiment of the present disclosure is coupled with the base frame from the left to the right of the base frame. FIGS. 11. 12. 13 and 14 are views for describing a process in which the cover frame according to an embodiment of the present disclosure is coupled with the base frame from the right to the left of the base frame.

Hereinafter, when the cover frame 130 slides to be coupled with the base frame 110, sliding from the left to the right of the base frame 110 is defined as sliding in a first direction, and sliding from the right to the left of the base frame 110 is defined as sliding in a second direction.

The refrigerator 1 according to an embodiment of the present disclosure may include a cover unit 100 to cover the electronic component accommodating space 13. The cover unit 100 may include a base frame 110 mounted on the main body 10 and primarily covering the electronic component accommodating space 13, a hinge cover 120 mounted on the base frame 110, and a cover frame 130 mounted on the base frame 110 and secondarily covering the electronic component accommodating space 13.

The base frame 110 may include a first hinge accommodating portion 111 and a second hinge accommodating portion 112 in the right and left portions respectively in order to mount the hinge 141 and the hinge cover 120 covering the hinge 141. More specifically, the first hinge accommodating portion 111 may be disposed in the right end portion of the base frame 110, and the second hinge accommodating portion 112 may be disposed in the left end portion of the base frame 110.

The first hinge accommodating portion 111 may penetrate the base frame 110 in a front-rear direction so that the hinge 141 fixed at the main body 10 through the hinge bracket 142 protrudes forward from the main body 10. When the hinge cover 120 is mounted on the first hinge accommodating portion 111, a part of the first hinge accommodating portion 111 may be covered by the hinge cover 120, and the remaining part of the first hinge accommodating portion 111 may be covered by the cover frame 130

When the hinge 141 and the hinge cover 120 are mounted on the first hinge accommodating portion 111, the door 30 can rotate with respect to the right end of the main body 10.

The second hinge accommodating portion 112 may penetrate the base frame 110 in the front-rear direction so that the hinge 141 fixed at the main body 10 through the hinge bracket 142 protrudes forward from the main body 10. When the hinge cover 120 is mounted on the second hinge accommodating portion 112, a part of the second hinge accommodating portion 112 may be covered by the hinge cover 120, and the remaining part of the second hinge accommodating portion 112 may be covered by the cover frame 130

If the hinge 141 and the hinge cover 120 are mounted on the second hinge accommodating portion 112, the door 30 can rotate with respect to the left end of the main body 10

The first hinge accommodating portion 111 and the second hinge accommodating portion 112 may be symmetrical with respect to the center of the refrigerator 1 in the left-right direction.

The base frame 110 may include a frame connecting portion 113 hooked with the frame hook 133 of the cover frame 130 so that the cover frame 130 can be mounted on the base frame 110. A plurality of frame connecting portions 113 may be provided.

The frame connecting portion 113 may be formed at the upper end and/or the lower end of the base frame 110. Although not shown, the frame connecting portion 113 may be formed at the center of the base frame 110.

As shown in FIG. 3, if the frame connecting portions 113 are provided at the upper and lower ends of the base frame 110, the shape of the frame connecting portion 113 provided at the upper end of the base frame 110 may be symmetrical to the shape of the frame connecting portion 113 provided at the lower end of the base frame 110 with respect to an imaginary baseline extending in the left-right direction. However, the frame connecting portions 113 may be disposed asymmetrically.

More specifically, the frame connecting portion 113 may include a hook inserting portion 113*a* into which a frame hook 133 to be described later is inserted, a first hook fixing portion 113*b* extending to the right from the hook inserting portion 113*a*, and a second hook fixing portion 113*c* extending to the left from the hook inserting portion 113*a*.

The hook inserting portion 113*a* may be larger than the first hook fixing portion 113*b* and the second hook fixing portion 113*c* so that a second extending portion 133*b* of the frame hook 133 to be described later can be inserted into the hook inserting portion 113*a*.

On the other hand, a first hook fixing portion 113*b* and a second hook fixing portion 113*c* may be smaller than the hook inserting portion 113*a* to prevent a second extending portion 133*b* from being separated from the frame connecting portion 113 when the cover frame 130 is mounted on the base frame 110.

That is, if the frame hook 133 is inserted into the first hook fixing portion 113*b* or the second hook fixing portion 113*c*, the cover frame 130 may be restricted from moving in a sliding direction (i.e. the left direction or the right direction), the vertical direction, and the front-rear direction with respect to the base frame 110, so that the cover frame 130 can be fixed at the base frame 110.

So far, the frame connecting portion 113 has been described, however, the shape of the frame connecting portion 113 is not limited to this. That is, the frame connecting portion 113 may have any configuration as long as it can enable the cover frame 130 to slide on the base frame 110 to be fixed at the base frame 110.

Referring to FIG. 6, the base frame 110 may include a first connecting portion 114*a* and a second connecting portion 114*b* which are hooked with the hinge cover hook 128 of the hinge cover 120 so that the hinge cover 120 can be mounted on the base frame 110. More specifically, the first connecting portion 114*a* may be provided in the first hinge accommodating portion 111 to be hooked with the hinge cover hook 128 when the hinge cover 120 is mounted on the first hinge accommodating portion 111 of the base frame 110, and the second connecting portion 114*b* may be provided in the second hinge accommodating portion 112 to be hooked with the hinge cover hook 128 when the hinge cover 120 is mounted on the second hinge accommodating portion 112 of the base frame 110.

The first connecting portion 114*a* may be provided at a position corresponding to the hinge cover hook 128 of the hinge cover 120 inside the first hinge accommodating portion 111, and the second connecting portion 114*b* may be provided at a position corresponding to the hinge cover hook 128 of the hinge cover 120 inside the second hinge accommodating portion 112.

The base frame 110 may include a connecting member 118 having a connecting hole 118*a*, and a base hook 115 extending from the rear surface of the base frame 110 toward the main body 10 so that the base frame 110 is mounted on the main body 10 to primarily cover the electronic component accommodating space 13.

More specifically, a plurality of base hooks 115 may be provided approximately symmetrically to the left and right portions of the base frame 110, respectively. The base hooks 115 may be provided at the left end of the first hinge accommodating portion 111 and the right end of the second hinge accommodating portion 112, respectively. The base hooks 115 may be hooked with base connecting holes 15 of the main body 10.

A plurality of connecting members 118 may be provided approximately symmetrically on the left and right portions of the base frame 110, respectively. The connecting members 118 may be provided at the right end of the first hinge accommodating portion 111 and the left end of the second hinge accommodating portion 112, respectively. The base frame 110 can be more firmly coupled with the main body 10 if screws are coupled to the connecting hole 118*a* of the connecting member 118 and the base hole 17 of the main body 10.

In the current embodiment, the base frame 110 may be coupled with the main body 10 through hook coupling and screw coupling, however, the base frame 110 may be coupled with the main body 10 through any one of hook coupling and screw coupling or in a tight fitting manner.

The base frame 110 may include a first base supporting portion 116 and a second base supporting portion 117 to support the hinge cover 120 to restrict lateral movement of the hinge cover 120 when the hinge cover 120 is mounted. The first base supporting portion 116 may be provided at the right end of the base frame 110, and the second base supporting portion 117 may be provided at the left end of the base frame 110. The first base supporting portion 116 and the second base supporting portion 117 may be in the shape of a groove so that one end 121 of the hinge cover 120 can be inserted into the first base supporting portion 116 and the second base supporting portion 117.

More specifically, when the hinge cover 120 is mounted on the first hinge accommodating portion 111, one end 121 of the hinge cover 120 may be supported by the first base supporting portion 116, and when the hinge cover 120 is mounted on the second hinge accommodating portion 112, one end 121 of the hinge cover 120 may be supported by the second base supporting portion 117.

Referring to FIGS. 4 to 6, the hinge cover 120 may be mounted on the base frame 110, and may include a first space 124 in which wires are disposed and second space 125 in which the hinge 141 is disposed. A wire guiding portion 123 may be provided between the first space 124 and the second space 125. More specifically, the hinge cover 120 may be mounted on one of the first hinge accommodating portion 111 and the second hinge accommodating portion 112, and may cover the hinge 141.

When the hinge cover 120 is mounted on the first hinge accommodating portion 111, one end 121 of the hinge cover 120 may be supported by the first base supporting portion 116 of the base frame 110, and the other end portion 129 of the hinge cover 120 may be supported by the cover supporting part 132 of the cover frame 130.

In addition, the hinge cover 120 may include a cover inserting portion 122 which the front end portion 131 of the cover frame 130 is inserted into and fixed in. More specifically, the cover inserting portion 122 may be provided in a shape corresponding to the end 131*a* of the front end portion 131 of the cover frame 130, so that the front end 131*a* may be inserted into and fixed in the cover inserting portion 122.

The wire guiding portion 123 may function to separate the wire from the hinge 141 to thus prevent the wire from contacting the hinge 141 in order not to be interfered with the hinge 141 when the wire extending from the electronic component accommodating space 13 to the door 30 to electrically connect the electronic components provided in the electronic component accommodating space 13 to the camera 40, the display 50 and/or the USB connecting unit 70 installed in the door 30 is disposed in the inside of the first space 124. That is, the wire guiding part 123 may guide the wire to be spaced apart from the hinge 141.

Referring to FIG. 6, the hinge cover 120 may include a hinge cover hook 128 that can be hooked with the base frame 110. As the hinge cover hook 128 is coupled with the first connecting portion 114*a* or the second connecting portion 114*b*, the hinge cover 120 may be restricted from moving in the vertical direction and the front-rear direction with respect to the base frame 110.

The hinge cover 120 may be mounted on the first hinge accommodating portion 111 or the second hinge accommodating portion 112 of the base frame 110. More specifically, the hinge cover 120 shown in FIGS. 7 and 9 may be configured to set the center of rotation of the door 30 to the right side of the main body 10, and the hinge cover 120' shown in FIGS. 11 and 13 may be configured to set the center of rotation of the door 30 to the left side of the main body 10.

That is, the refrigerator 1 according to the embodiment of the present disclosure may be configured to replace only the hinge cover 120 and use the base frame 110 and the cover frame 130 as they are so that the center of rotation of the door 30 with respect to the main body 10 can be easily moved to the right end or the left end. The refrigerator 1 according to the embodiment of the present disclosure may easily mount the hinge 141 on the right end or the left end of the main body 10 in consideration of an installation environment.

The hinge cover 120 shown in FIGS. 3, and 5 may be mounted on the first hinge accommodating portion 111, and accordingly, the center of rotation of the door 30 may become the right end of the main body 10. The hinge cover 120 covering the hinge 141 for guiding the rotation of the door 30 may include an arc portion 126 formed in the shape of an arc that is convex leftward in the front portion of the main body 10 in consideration of the rotation trajectory of the door 30, and a door connecting portion 127 disposed at one end portion of the arc portion 126 spaced apart from the main body 10 and connected to the hinge 141 and the door 30.

Figure 13:
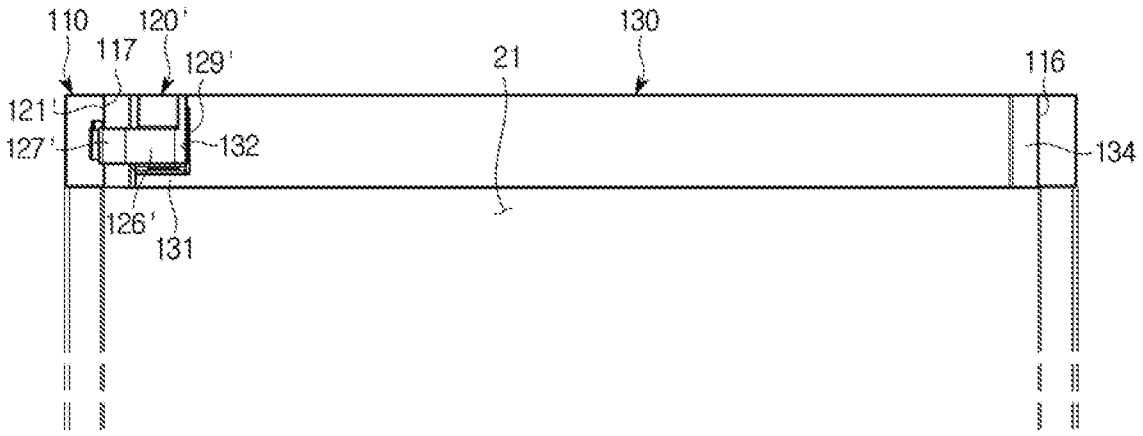
Figure 14:
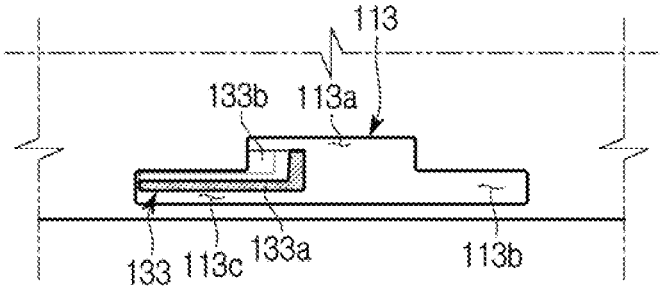

On the other hand, the hinge cover 120' shown in FIGS. 11 and 13 may be mounted on the second hinge accommodating portion 112, and accordingly, the center of rotation of the door 30 may become the left end of the main body 10. The hinge cover 120' covering the hinge (not shown) for guiding the rotation of the door 30 may include an arc portion 126' formed in the shape of an arc that is convex rightward in the front portion of the main body 10 in consideration of the rotation trajectory of the door 30, and a door connecting portion 127' provided at one end portion of the arc portion 126' spaced apart from the main body 10 and connected to the hinge and the door 30.

That is, the shapes of the arc portion 126 and the door connection portion 127 of the hinge cover 120 mounted on the first hinge accommodating portion 111 may be opposite to those of the arc portion 126' and the door connecting portion 127' of the hinge cover 120' mounted on the second hinge accommodating portion 112, respectively.

In addition, if the hinge cover 120' is mounted on the second hinge accommodating portion 112, one end 121' of the hinge cover 120' may be supported by the second base supporting portion 117 of the base frame 110, and the other end 129' of the hinge cover 120' may be supported by the cover supporting portion 132 of the cover frame 130. That is, when the hinge cover 120' mounted on the second hinge accommodating portion 112 is compared with the hinge cover 120 mounted on the first hinge accommodating portion 111, the position of the base frame 110 at which the one end 121 is supported may be different from that of the base frame 110 at which the one end 121' is supported.

The cover frame 130 may cover the entire of one of the first hinge accommodating portion 111 and the second hinge accommodating portion 112, while covering a portion of the other one. That is, the cover frame 130 may secondarily cover the electronic component accommodating space 13 primarily covered by the base frame 110 to prevent the electronic component accommodating space 13 from being exposed to the outside.

The cover frame 130 may be provided to cover the remaining portion of the base frame 110 except for the portion of the front surface of the base frame 110 covered by the hinge cover 120. Accordingly, the outer appearance of the refrigerator 1 according to the embodiment of the present disclosure may be improved since wires connecting the components are not shown in the cover unit 100 disposed in the upper portion of the upper storage compartment 21, as if the cover unit 100 is integrated into one body, when the door 30 is opened or closed.

The cover frame 130 may be coupled with the base frame 110 from the left to the right of the base frame 110 or from the right to the left of the base frame 110, according to the position at which the hinge cover 120 is coupled with the base frame 110. That is, if the hinge cover 120 is installed in the first hinge accommodating portion 111, the cover frame 130 may be coupled with the base frame 110 from the left to the right of the base frame 110, and if the hinge cover 120 is installed in the second hinge accommodating portion 112, the cover frame 130 may be coupled with the base frame 110 from the right to the left of the base frame 110.

The cover frame 130 may include the front end portion 131 that is inserted into the cover inserting portion 122 of the hinge cover 120. More specifically, the front end portion 131 may include the front end 131*a* protruding in the sliding direction of the cover frame 130, and the front end 131*a* may be inserted into the cover inserting portion 122.

The cover frame 130 may include a cover supporting portion 132 to support the hinge cover 120 in the sliding direction. The cover supporting portion 132 may support the other end portion 129 of the hinge cover 120. More specifically, if the hinge cover 120 is installed in the first hinge accommodating portion 111, the cover supporting portion 132 may support the hinge cover 120 from the left to the right, and if the hinge cover 120' is installed in the second hinge accommodating portion 112, the cover supporting portion 132 may support the hinge cover 120' from the right to the left.

The cover frame 130 may include a frame hook 133 to be coupled with the base frame 110. The frame hook 133 may include a first extending portion 133*a* extending from the rear surface of the cover frame 130, and a second extending portion 133*b* extending upward from the rear end portion of the first extending portion 133*a*.

The frame hook 133 may be inserted into the frame connecting portion 113 of the base frame 110, and then slide to fix the cover frame 130 at the base frame 110.

Referring to FIGS. 7, 8, 9 and 10, if the hinge cover 120 is installed in the first hinge accommodating portion 111, the frame hook 133 may be inserted into the frame connecting portion 113, and then slide to be located in a first hook fixing portion 113*b*. At this time, the first extending portion 133*a* may be restricted from moving in the right direction and the vertical direction by the first hook fixing portion 113*b*, and the second extending portion 133*b* may be restricted from moving in the front-rear direction by the first hook fixing portion 113*b*. Also, the cover frame 130 may be positioned such that the other end portion 134 is supported by the second base supporting portion 117 of the base frame 110, and accordingly, the base frame 110, the hinge cover 120, and the cover frame 130 may be mutually supported and fixed.

With the configuration, the refrigerator 1 according to the embodiment of the present disclosure can minimize the gaps between the components of the cover unit 100 while improving assembling efficiency.

On the other hand, referring to FIGS. 11, 12, 13, 14 and 15, if the hinge cover 120 is mounted on the second hinge accommodating portion 112, the frame hook 133 may be inserted into the frame connecting portion 113, and then slide to be positioned in a second hook fixing portion 113*c*. At this time, the first extending portion 133*a* may be restricted from moving in the left direction and the vertical direction by the second hook fixing portion 113*c*, and the second extending portion 133*b* may be restricted from moving in the front-rear direction by the second hook fixing portion 113*c*. Also, the cover frame 130 may be positioned such that the other end portion 134 is supported by the first base supporting portion 116 of the base frame 110, and accordingly, the base frame 110, the hinge cover 120, and the cover frame 130 may be mutually supported and fixed.

The hinge 141 may be disposed in the second space 125 formed in the inside of the hinge cover 120, and the hinge protrusion 141*a* may be inserted into and fixed in the hinge groove 142*b* of the hinge bracket 142.

The hinge bracket 142 may fix the hinge 141, and may include the hinge groove 142*b* into which the hinge protrusion 141*a* of the hinge 141 is inserted, and a main body hole 142*a* corresponding to the bracket fixing groove 16 of the main body and fixing the hinge bracket 142 to the main body 10 by screwing.

The middle hinge 143 may be installed on the horizontal partition 23 of the main body 10 by means of the middle hinge bracket 144. The middle hinge 143 can change the mounting position together with the hinge 141 when the mounting position of the hinge 141 changes from the right to the left of the main body 10.

As described above, in the refrigerator 1 according to the embodiment of the present disclosure, the base frame 110 may be formed symmetrically with respect to the center in the left-right direction, and the cover frame 130 can be coupled with the base frame 110 from the left to the right of the base frame 110 or from the right to the left of the base frame 110. Accordingly, the refrigerator 1 does not require a number of separate parts for changing the installation position of the hinge 141. Accordingly, the refrigerator 1 according to the embodiment of the present disclosure can easily change the installation position of the hinge 141.

Figure 15:
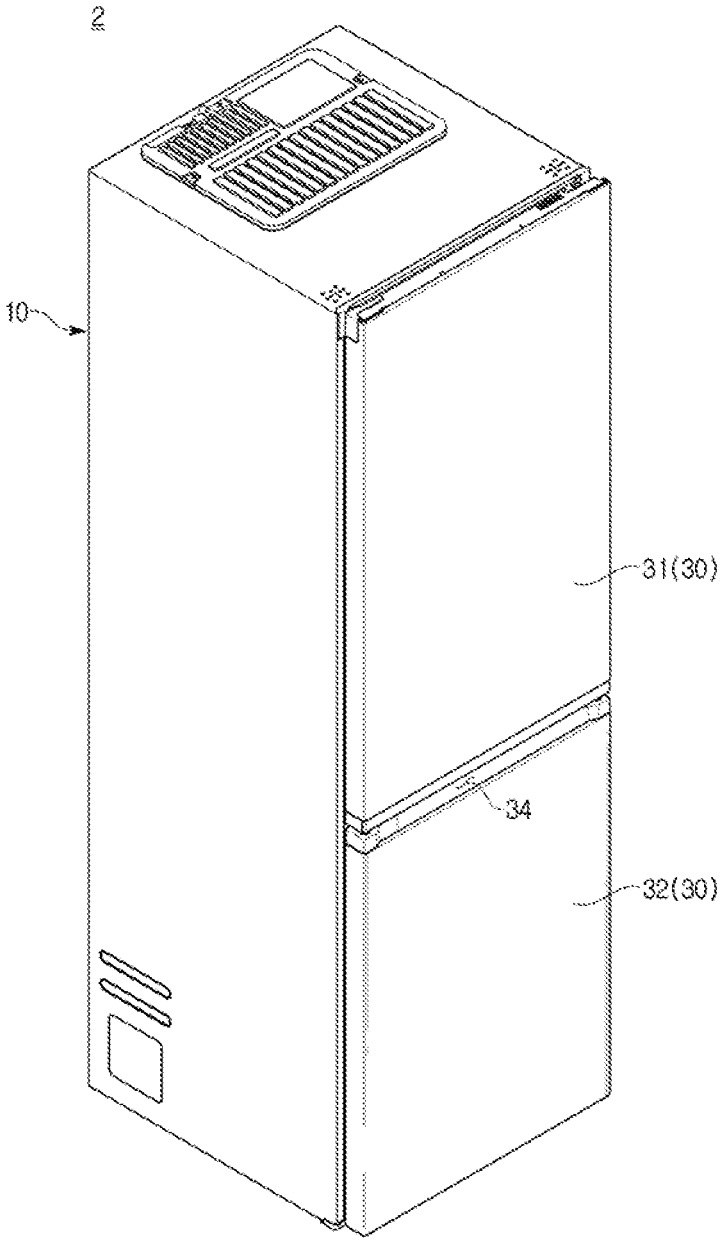
FIG. 15 shows the outer appearance of a refrigerator according to another embodiment of the present disclosure.

FIG. 15 shows the outer appearance of a refrigerator according to another embodiment of the present disclosure.

A refrigerator 2 according to another embodiment will be described with reference to FIG. 15. In the following description, the same components as those in the embodiments shown in FIGS. 1 to 14 may be assigned the same reference numerals, and detailed descriptions thereof will be omitted.

Referring to FIG. 15, the refrigerator 2 according to another embodiment of the present disclosure may include no display. Also, the refrigerator 2 may include neither a cover member for covering the speaker assembly nor a USB connecting unit for connecting the USB. That is, the refrigerator 2 shown in FIG. 15 may be a refrigerator that does not require any wires extending to the door 30.

That is, the cover unit 100 described above with reference to FIGS. 3, 4, 5, 6, 7, 8, 9, 10, 11, 12 13 and 14 may be applied to a typical refrigerator in which neither a display nor a USB connecting unit are provided.

According to the present disclosure, since the refrigerator can be coupled and separated by causing the cover frame to slide on the base frame that primarily covers the space for accommodating electronic components, the refrigerator can be easily assembled or dissembled.

According to the present disclosure, the refrigerator can be installed by easily changing the center of rotation of the door by replacing only the hinge cover while using the base frame and the cover frame as they are.

According to the present disclosure, since the cover frame covers the major portion of the front surface of the base frame, the outer appearance of the refrigerator can be improved.

According to the present disclosure, since the hinge cover, the cover frame, and the base frame covering the space for accommodating electronic components are coupled in such a way to be supported with respect to each other, the refrigerator can improve a gap made between the components.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body;

a storage compartment formed in the main body;

a door to open and close the storage compartment to store food;

a hinge mounted to the main body to rotatably support the door;

a base frame mounted to the main body, and the base frame having a first hinge accommodating portion formed at one end portion thereof and a second hinge accommodating portion formed at the other end portion thereof that is opposite to the one end portion to accommodate the hinge;

a hinge cover mounted to one of the first hinge accommodating portion and the second hinge accommodating portion, and the hinge cover configured to cover the hinge accommodated in the one of the first hinge accommodating portion and the second hinge accommodation portion; and a cover frame configured to be coupled with the base frame by sliding in a first direction when the hinge is accommodated in the first hinge accommodating portion or by sliding in a second direction that is opposite to the first direction when the hinge is accommodated in the second hinge accommodating portion, wherein one end portion of the hinge cover is supported by the base frame, and the other end portion of the hinge cover that is opposite to the one end portion of the hinge cover is supported by the cover frame.

2. The refrigerator of claim 1, wherein the cover frame is coupled with the base frame by sliding in the first direction when the hinge cover is mounted to the first hinge accommodating portion, and the cover frame is coupled with the base frame by sliding in the second direction when the hinge cover is mounted to the second hinge accommodating portion.

3. The refrigerator of claim 1, wherein the first direction is a direction from the other end portion of the base frame to the one end portion of the base frame, and the second direction is a direction from the one end portion of the base frame to the other end portion of the base frame.

4. The refrigerator of claim 1, wherein the cover frame is configured to cover an entire of one of the first hinge accommodating portion and the second hinge accommodating portion, and a part of the other one of the first hinge accommodating portion and the second hinge accommodating portion.

5. The refrigerator of claim 1, wherein the cover frame includes a frame hook, and the base frame includes a frame connecting portion connected to the frame hook.

6. The refrigerator of claim 5, wherein the frame hook comprises:

a first extending portion configured to restrict a movement of the cover frame in a direction in which the cover frame slides and in a third direction that is perpendicular to the direction in which the cover frame slides; and a second extending portion configured to restrict a movement of the cover frame in a fourth direction that is perpendicular to the direction in which the cover frame slides and perpendicular to the third direction.

7. The refrigerator of claim 5, wherein the frame connecting portion includes:

a hook inserting portion into which the frame hook is inserted;

a first hook fixing portion extending from the hook inserting portion in the first direction of the base frame; and a second hook fixing portion extending from the hook inserting portion in the second direction of the base frame.

8. The refrigerator of claim 1, wherein the door includes at least one of a camera, a display and a Universal Serial Bus (USB) connecting unit, and the main body includes space formed therein to accommodate one or more electronic components of the refrigerator so that a wire disposed in the space passes through inside of the hinge cover and extends to be connected to the at least one of a camera, a display and a USB connecting unit to connect with the one or more electronic components.

9. The refrigerator claim 1, wherein the hinge cover includes a wire guiding part configured to guide a wire disposed in inside of the hinge cover to be spaced apart from the hinge.

10. The refrigerator of claim 1, wherein the base frame includes a first connecting portion formed in the first hinge accommodating portion and a second connecting portion formed in the second hinge accommodating portion, and the hinge cover includes a hinge cover hook having elasticity and configured to be hooked to one of the first connecting portion and the second connecting portion.

11. The refrigerator of claim 1, wherein the hinge cover includes a cover inserting portion which a portion of a front end portion of the cover frame is inserted into and fixed in along a direction in which the cover frame slides.

12. The refrigerator of claim 1, wherein the base frame is coupled with the main body by at least one of hook coupling and screw coupling.

13. The refrigerator of claim 1, wherein the cover frame includes a pair of cover supporting portions at one end portion thereof and a cavity, corresponding to the hinge cover, formed between the pair of covers supporting portions.

14. The refrigerator of claim 1, wherein one end portion of the cover frame is supported by the hinge cover, and the other end portion of the cover frame that is opposite to the one end portion of the cover frame is supported by the base frame.

15. The refrigerator of claim 1, wherein the base frame is formed such that one side of the base frame in which the first hinge accommodating portion is formed and the other side of the base frame in which the second hinge accommodating portion is formed are symmetrical with respect to a center of the base frame in a direction in which the cover frame slides.

16. A refrigerator, comprising:

a main body having space formed at an upper portion thereof to accommodate electronic components;

a base frame mounted to the main body to cover an open front portion of the space, the base frame including a first hinge accommodating portion formed at a right end portion thereof and a second hinge accommodating portion formed at a left end portion thereof;

a hinge cover mounted to one of the first hinge accommodating portion and the second hinge accommodating portion and configured to cover a hinge accommodated in the one of the first hinge accommodating portion and the second hinge accommodation portion; and a cover frame configured to be coupled with the base frame by sliding from a left of the base frame to a right of the base frame when the hinge cover is mounted to the first hinge accommodating portion, and to be coupled with the base frame by sliding from the right of the base frame to the left of the base frame when the hinge cover is mounted to the second hinge accommodating portion, wherein one end portion of the hinge cover is supported by the base frame, and the other end portion of the hinge cover that is opposite to the one end portion of the hinge cover is supported by the cover frame.

17. The refrigerator of claim 16, wherein the hinge cover includes a wire guiding part to guide a wire disposed inside of the hinge cover to be spaced apart from the hinge.

18. The refrigerator of claim 16, wherein the base frame is formed to be symmetrical with respect to a center of the base frame in a direction in which the cover frame slides.

19. A refrigerator comprising:

a main body having electronic component accommodating space formed therein to accommodate electronic components;

a base frame mounted to the main body to cover an open portion of the space, the base frame including a first hinge accommodating portion formed at one end portion thereof and a second hinge accommodating portion formed at the other end portion thereof that is opposite to the one end portion;

a hinge cover mounted to one of the first hinge accommodating portion and the second hinge accommodating portion and configured to cover a hinge accommodated in the one of the first hinge accommodating portion and the second hinge accommodation portion; and a cover frame configured to cover an entire of one of the first hinge accommodating portion and the second hinge accommodating portion, and a part of the other one of the first hinge accommodating portion and the second hinge accommodating portion and to be coupled with the base frame by sliding in a first direction or in a second direction that is opposite to the first direction, wherein one end portion of the hinge cover is supported by the base frame, and the other end portion of the hinge cover that is opposite to the one end portion of the hinge cover is supported by the cover frame.

20. The refrigerator of claim 19, wherein the cover frame is coupled with the base frame by sliding in the first direction when the hinge cover is mounted to the first hinge accommodating portion, and the cover frame is coupled with the base frame by sliding in the second direction when the hinge cover is mounted to the second hinge accommodating portion.

* * * * *